US006533909B2

(12) United States Patent
Duruz et al.

(10) Patent No.: US 6,533,909 B2
(45) Date of Patent: Mar. 18, 2003

(54) BIPOLAR CELL FOR THE PRODUCTION OF ALUMINIUM WITH CARBON CATHODES

(75) Inventors: Jean-Jacques Duruz, Geneva (CH); Vittorio de Nora, Nassan (BA)

(73) Assignee: Moltech Invent S.A. (LU)

( * ) Notice: Subject to any disclaimer, the term of this patent is extended or adjusted under 35 U.S.C. 154(b) by 89 days.

(21) Appl. No.: 09/772,284

(22) Filed: Jan. 29, 2001

(65) Prior Publication Data

US 2001/0017267 A1 Aug. 30, 2001

Related U.S. Application Data

(63) Continuation of application No. PCT/IB99/01438, filed on Aug. 17, 1999.

(51) Int. Cl.[7] ..... B01D 59/40

(52) U.S. Cl. ..... 204/243.1; 204/247.4; 205/372; 205/377; 205/380; 205/384; 205/386; 205/387

(58) Field of Search ..... 204/243.1, 247.4; 205/372, 377, 380, 384, 386, 387

*Primary Examiner*—Bruce F. Bell
(74) *Attorney, Agent, or Firm*—Jayadeep R. Deshmukh

(57) ABSTRACT

A bipolar cell for the electrowinning of aluminium has bipolar electrodes each comprising a carbon cathode body having on one side an active surface on which aluminium is produced and connected on the other side through an oxygen impermeable barrier layer to an electrochemically active anode layer having an oxygen evolving iron oxide-based outer surface. The anode layer may comprise a metal-based anode substrate and a transition metal oxide-based outside layer, in particular an iron oxide-based outside layer, which either is an applied layer or is obtainable by oxidising the surface of the anode substrate which contains iron. During operation, the anode layer can be kept dimensionally stable by maintaining in the electrolyte a concentration of transition metal species which are present as one or more corresponding transition metal oxides in the electrochemically-active layer. The cell operating temperature is sufficiently low so that the required concentration The cell operating temperature is sufficiently low so that the required concentration of transition metal species in the electrolyte is limited by the reduced solubility thereof in the electrolyte at the operating temperature. This limits the contamination of the product aluminium by the transition metal species to an acceptable level.

39 Claims, No Drawings

BIPOLAR CELL FOR THE PRODUCTION OF ALUMINIUM WITH CARBON CATHODES

This application is a continuation of the US designation of PCT/IB99/01438 filed on Aug. 17, 1999.

FIELD OF THE INVENTION

This invention relates to bipolar cells for the electrowinning of aluminium by the electrolysis of alumina dissolved in a molten fluoride-containing electrolyte provided with bipolar electrodes having carbon cathodes and oxygen-evolving anodes, methods for the fabrication and reconditioning of such electrodes, and the operation of such cells to maintain the anodes dimensionally stable.

BACKGROUND ART

The technology for the production of aluminium by the electrolysis of alumina, dissolved in molten cryolite containing salts, at temperatures around 950° C. is more than one hundred years old.

This process, conceived almost simultaneously by Hall and Heroult, and the cell design have not undergone any great change or improvement and carbonaceous materials are still used as electrodes and cell linings.

A major drawback of conventional cells is due to the fact that irregular electromagnetic forces create waves in the molten aluminium pool and the anode-cathode distance (ACD), also called inter-electrode gap (IEG), must be kept at a safe minimum value of approximately 5 cm to avoid short circuiting between the aluminium cathode and the anode or re-oxidation of the metal by contact with the $CO_2$ gas formed at the anode surface.

The high electrical resistivity of the electrolyte causes a voltage drop in the inter-electrode gap which alone represents as much as 40% of the total voltage drop with a resulting low energy efficiency.

All aluminium production cells commercially used today have carbon anodes and carbon cathodes. Only recently has it become possible to make the carbon cathode surface aluminium-wettable by means of an applied coating obtained from an applied slurry or colloidal dispersion containing titanium diboride as described in U.S. Pat. No. 5,651,874 (de Nora/Sekhar). Making the cathode surface aluminium-wettable allowed the design of drained cells with reduced anode-cathode distance (ACD) and therefore to save energy as described in U.S. Pat. No. 5,683,559 (de Nora).

Twenty years of intense and costly research made it possible to design non-carbon anodes which eliminate the severe pollution during their fabrication and utilisation. Improvements have been achieved, as described in co-pending applications WO99/36591 and WO99/36592 (both in the name of de Nora), WO99/36593 and WO99/36594 (both in the name of de. Nora/Duruz) which disclose anodes having a metal core resistant to cryolite and oxygen, and an electrochemically active coating.

Several past attempts were made to design bipolar cells in order to overcome the problems encountered with conventional aluminium electrowinning cells. In order to make their use economic, bipolar cells need electrodes which are resistant to the products of electrolysed aluminium salts. Using consumable electrodes in bipolar cells is not acceptable as their replacement is much more difficult and their consumption enlarges the anode-cathode gap (ACG) and cannot be compensated by repositioning the electrodes as in Hall-Héroult cells.

U.S. Pat. Nos. 3,822,195 and 3,893,899 (both in the name of Dell/Haupin/Russel) and U.S. Pat. No. 4,110,178 (LaCamera/Trzeciak/Kinosz) all describe bipolar cells operating with carbon electrodes and with an electrolytic bath containing aluminium chloride instead of alumina. However, these cell designs have not been commercially adopted.

U.S. Pat. No. 3,578,580 (Schmidt-Hatting/Huwyler) discloses bipolar cells, in particular having inclined electrodes, wherein the anodes are made of oxygen-resistant material such as platinum or a conductive oxide or wustite (ferrous oxide FeO). The cathode is made of carbon, or other electrically conductive material resistant to fused melt, such as a carbide of titanium, zirconium, tantalum or niobium.

U.S. Pat. No. 3,930,967 (Alder) describes a bipolar cell electrode comprising an anode, an intermediate plate and a cathode plate held together in an alumina or magnesium oxide frame. The anode plate is made of ceramic oxide material, the preferred material being tin oxide with copper oxide and antimony oxide. The cathode is graphite or made of borides, carbides, nitrides, silicides, in particular of metals such as titanium, zirconium or silicon. The intermediate plate, for instance made of silver, nickel or cobalt, prevents direct contact between the anode and the cathode plates to avoid any reaction between them when exposed to high temperature.

U.S. Pat. No. 5,019,225 (Darracq/Duruz/Durmelat) discloses a bipolar electrode for an aluminium electrowinning cell having a cerium oxyfluoride anode surface and a cerium hexaboride cathode surface, which was specially designed for use in the process of U.S. Pat. No. 4,614,569 (Duruz/Derivaz/Debely/Adorian) wherein cerium species dissolved in the electrolyte maintain the anode surface stable.

Despite all previous attempts, the bipolar technology has never been successfully implemented in industrial aluminium production cells due to many problems of cell operation.

SUMMARY OF THE INVENTION

It is an object of the invention to provide a bipolar electrode for aluminium electrowinning bipolar cells, which has an oxygen resistant anode surface.

Another object of the invention is to provide a bipolar electrode for aluminium electrowinning bipolar cells, which contains carbon but which is not exposed to carbon oxidation so as to eliminate carbon-generated pollution and high costs of carbon consumption.

Yet another object of the invention is to provide a bipolar electrode for aluminium electrowinning bipolar cells whose anodic surface has a sufficient operative lifetime to make its use commercially acceptable.

An important object of the invention is to provide a bipolar electrode for aluminium electrowinning bipolar cells, which may be maintained dimensionally stable, without excessively contaminating the product aluminium.

Yet another object of the invention is to provide an aluminium electrowinning bipolar cell operating under such conditions that the contamination of the product aluminium is limited.

The invention relates to a bipolar cell for the electrowinning of aluminium by the electrolysis of alumina dissolved in a molten fluoride-containing electrolyte, having a terminal cathode, a terminal anode and thereinbetween at least one bipolar electrode. The bipolar electrode comprises a carbon cathode body having on one side an electrochemically active surface on which aluminium is produced and connected on the other side through an oxygen impermeable barrier layer to an anode layer having a metal oxide outer surface which is electrochemically active for the oxidation reaction of oxygen ions into nascent monoatomic oxygen.

More generally, the metal oxide may be present in the electrochemically outer surface in a multi-compound mixed oxide, in mixed crystals and/or in a solid solution of oxides. The oxide may be in the form of a simple, double and/or multiple oxide, and/or in the form of a stoichiometric or non-stoichiometric oxide.

Oxygen Barrier Layers & Protective Layers

The oxygen barrier layer may be made of a metal or an oxidised metal, an intermetallic compound, a mixed perovskite ceramic, a phosphide, a carbide, a nitride such as titanium nitride, or a combination thereof.

Suitable metals or oxides of metals acting as a barrier to oxygen may be selected from chromium, chromium oxide, niobium, niobium oxide, nickel and nickel oxide. The oxygen barrier layer may in particular consist of a 5 to 20 micron thick layer of noble metal, such as platinum, palladium, iridium or rhodium. Intermetallic compounds such as silver-palladium, chromium-manganese and chromium-molybdenum also act as a barrier to oxygen.

The oxygen barrier may contain a mixed perovskite ceramic which may be chosen among zirconate, cobaltite, chromite, chromate, manganate, ruthenate, niobiate, tantalate and tungstate. The perovskite preferably contains strontium zirconate to enhance the conductivity of the oxygen barrier layer. A conductive phosphide resistant to oxygen may be chosen among a phosphide of titanium, chromium and tungsten. A suitable carbide may be selected from a carbide of chromium, titanium tantalum, niobium and/or molybdenum.

In addition, the bipolar electrode may advantageously comprise an intermediate protective layer, usually made of copper, or a copper nickel alloy, or oxide(s) thereof, which is located between the anode layer and the oxygen barrier layer and protects the oxygen barrier layer by inhibiting its dissolution.

The oxygen barrier layer may be bonded and secured to the carbon body directly or through at least one inert, electrically conductive, intermediate bonding layer such as a nickel and/or copper layer.

The oxygen barrier layer, and when present the intermediate bonding layer and/or the intermediate protective layer, may be formed by chemical or electrochemical deposition, chemical vapour deposition (CVD), physical vapour deposition (PVD), plasma or arc spraying, flame spraying, painting, bushing, dipping or slurry dipcoating.

At least one layer selected from the oxygen barrier layer, the anode layer, and when present the intermediate bonding layer and the intermediate protective layer, may be obtained by micropyretic reaction to form a porous layer enhancing thermal expansion match. At least two juxtaposed porous layers may be simultaneously produced micropyretically. Two layers may also be joined by a micropyretically obtained joint.

Cathode Bodies

The cathode body may be made of petroleum coke, metallurgical coke, anthracite, graphite, amorphous carbon, fullerene and low density carbon.

Advantageously, the side of the cathode body which is connected to the anode layer may be impregnated and/or coated with a phosphate of aluminium, such as monoaluminium phosphate, aluminium phosphate, aluminium polyphosphate and aluminium metaphosphate, as described in U.S. Pat. No. 5,534,130 (Sekhar). Alternatively, the side of the cathode body which is connected to the anode layer may be impregnated and/or coated with a boron compound, such as boron oxide, boric acid and tetraboric acid, by following the teachings disclosed in U.S. Pat. No. 5,486,278 (Manganiello/Duruz/Bellò). The impregnation and/or coating is usually achieved from a solution or a slurry which is applied into/onto the surface of the cathode body, possibly assisted by vacuum, and heat treated.

During use in the cell, the carbon of the cathode body may be exposed to the molten cell contents, in particular to produced aluminium. Alternatively, the carbon cathode body may comprise a drained aluminium-wettable outer coating on which aluminium is produced. However, great care should be taken for designing the electrode to prevent the produced aluminium from draining onto or otherwise coming into contact with the oxide-based anode layer, particularly when containing iron-oxide.

An aluminium-wettable cathode coating may for instance comprise a refractory hard metal boride, for example a boride selected from borides of titanium, chromium, vanadium, zirconium, hafnium, niobium, tantalum, molybdenum and cerium, and combinations thereof.

Preferably, the aluminium-wettable coating is a non-reactively sintered coating of preformed particulate refractory hard metal boride, as described in U.S. Pat. No. 5,651,874 (de Nora/Sekhar). However, the aluminium-wettable coating may also be a micropyretically-reacted coating produced from a refractory hard metal boride precursor as described in U.S. Pat. Nos. 5,310,476 and 5,364,513 (both in the name of Sekhar/de Nora).

The aluminium-wettable coating may be a dried and/or heat treated slurry containing refractory hard metal boride and/or a precursor thereof. The slurry may comprise a colloid selected from colloidal silica, alumina, yttria, ceria, thoria, zirconia, magnesia, lithia, tin oxide, zinc oxide, acetates and formates thereof as well as oxides and hydroxides of other metals, cationic species and mixtures thereof, as described in the patents mentioned in the previous paragraph. The aluminium-wettable coating may advantageously be aluminised prior to use

Electrochemically Active Anode Layers

The electrochemically active anode layer may for instance comprise a metal, alloy, intermetallic compound or cermet which during normal operation in the cell is slowly consumable by oxidation of its surface and dissolution into the electrolyte of the formed surface oxide. In this case the rate of oxidation may be substantially equal to the rate of dissolution.

Such anode layer may contain or consist of at least one metal selected from nickel, copper, cobalt, chromium, molybdenum, tantalum, tungsten, iron and combinations thereof.

Optionally, the electrochemically active layer may further comprise at least one additive selected from beryllium, magnesium, yttrium, titanium, zirconium, vanadium, niobium, tantalum, chromium, molybdenum, tungsten, manganese, rhodium, silver, hafnium, lithium, cerium and other Lanthanides.

Advantageously, the electrochemically active layer may also comprise at least one electrocatalyst for the anode reaction selected from iridium, palladium, platinum, rhodium, ruthenium, silicon, tin, mischmetal and metals of the Lanthanide series, and mixture, oxides and compounds thereof, for example as disclosed in WO99/36592 (de Nora).

The electrochemically active layer may comprise spinels and/or perovskites, in particular ferrites selected from the group consisting of cobalt, copper, manganese, magnesium, nickel and zinc ferrite, and mixtures thereof, such as nickel ferrite partially substituted with $Fe^{2}+$. Additionally, the ferrite may be doped with at least one oxide selected from chromium, titanium, tin and zirconium oxide.

The electrochemically active layer can also comprise ceramic oxides containing combinations of divalent nickel, cobalt, magnesium, manganese, copper and zinc with divalent/trivalent nickel, cobalt, manganese and/or iron. The electrochemically active layer may for instance have doped, non-stoichiometric and/or partially substituted spinels, the doped spinels comprising dopants selected from $Ti^{4}+$, $Zr^{4}+$, $Sn^{4}+$, $Fe^{4}+$, $Hf^{4}+$, $Mn^{4}+$, $Fe^{3}+$, $Ni^{3}+$, $Co^{3}+$, $Mn^{3}+$, $Al^{3}+$, $Cr^{3}+$, $Fe^{2}+$, $Ni^{2}+$, $Co^{2}+$, $Mg^{2}+$, $Mn^{2}+$, $Cu^{2}+$, $Zn^{2}+$ and $Li^{+}$.

Advantageously, the electrochemically active layer is initially sufficiently thick to constitute an impermeable barrier to gaseous oxygen penetration, and even to nascent, mono-atomic oxygen.

Transition Metal-Based Anode Layers

In other embodiments the electrochemically active outside layer comprises a transition metal oxide, such as iron oxide, cobalt oxide, nickel oxide or combination thereof.

Whereas nickel as well as cobalt on their own are poor candidates as electrochemically active materials for aluminium electrowinning cells, an alloy of nickel and cobalt shows the following properties. A nickel-cobalt alloy forms upon oxidation complex oxides, in particular $(Ni_xCo_{1-x})^O$, having semi-conducting properties. Furthermore, nickel-cobalt oxides provide an advantage over conventional nickel ferrite. Whereas trivalent iron ions of nickel ferrite are slowly replaced by trivalent aluminium ions in the octahedral sites of the spinel lattice, which leads to a loss of conductivity and of mechanical stability, nickel-cobalt alloys oxidised in oxygen at 1000° C. lead to a semi-conducting mixed oxide structure of $NiCo_2O_4$ and $Co_3O_4$ spinels which is similar to the NaCl lattice. In these spinels, a replacement of trivalent cobalt ions by trivalent aluminium ions is unlikely.

In order to form an electrochemically active layer suitable for aluminium electrowinning anodes, the cobalt nickel atomic ratio is preferably chosen in the range of 2 to 2.7.

In a preferred embodiment, the anode layer has an iron oxide-based outer surface, in particular a hematite-based outer surface.

An iron oxide-based outer surface means that the surface contains predominately iron oxide, as a simple oxide such as hematite, or as part of an electrically conductive and electrochemically active double or multiple oxide, such as a ferrite, in particular cobalt, manganese, nickel, magnesium or zinc ferrite.

The anode layer may comprise iron oxide throughout its thickness. Alternatively, the anode layer may comprise an anode substrate which may be passivatable and an iron oxide-based outside layer which either is an applied layer or is obtainable by oxidising the surface of the anode substrate which contains iron. Alternatively, outside layers made of other transition metal oxide may be applied on such a substrate.

Usually the anode substrate comprises a metal, an alloy, an intermetallic compound or a cermet, such as nickel, copper, cobalt, chromium, molybdenum, tantalum, tungsten, iron, and their alloys or intermetallic compounds, or combinations thereof, in particular an alloy consisting of 10 to 30 weight % of chromium, 55 to 90% of at least one of nickel, cobalt or iron, and 0 to 15% of aluminium, titanium, zirconium, yttrium, hafnium or niobium.

The anode substrate may be made of iron, or an alloy of iron and at least one alloying metal selected from nickel, cobalt, molybdenum, tantalum, tungsten, niobium, titanium, zirconium, manganese and copper. Such an anode substrate may advantageously be surface oxidised to form the iron-oxide-based outside layer. For instance, the anode substrate alloy may comprise from 30 to 70 weight % iron, and from 30 to 70 weight % nickel.

The iron oxide-based layer may comprise a dense iron oxide outer portion, a microporous intermediate iron oxide portion and an inner portion containing iron oxide and a metal from the surface of the anode substrate.

The iron oxide-based (outside) layer may be formed by electrodepositing iron oxide, plasma or arc spraying iron oxide or iron as such followed by a heat treatment, or applying iron oxide or a precursor thereof in a slurry and drying and/or heat treating.

The iron oxide-based layer may be applied as a colloidal and/or polymeric slurry. The colloidal and/or polymeric slurry may comprise alumina, ceria, lithia, magnesia, silica, thoria, yttria, zirconia, tin oxide, zinc oxide or iron oxide, or a heat convertible precursor thereof, all in the form of a colloid or a polymer.

The iron oxide-based layer may be formed, or consolidated, by heat treating the anode substrate, the surface of which contains iron and/or iron oxide, in an oxidising gas at a temperature which is above the operating temperature of the cell usually at a temperature of 950° C. to 1250° C. However, the carbon cathode body should not be exposed to an oxidation treatment. If joined to the anode layer, the carbon cathode body may be separately protected from oxidation. Alternatively, the carbon cathode body may be joined to the anode layer after oxidation.

Any of the above-mentioned layers may be slurry applied, for instance by applying a precursor slurry. The layers may also be applied in the form a precursor powder followed by heat-treating.

Several techniques may be used to apply the layers,.such as dipping, spraying, painting, brushing, arc spraying, plasma spraying, arc spraying, electrochemical deposition, physical vapour deposition, chemical vapour deposition or calendar rolling.

HSLA Anode Layers

Further anode substrate materials which may be used for forming the electrochemically active layer include high-strength low-alloy (HSLA) steels.

It has been observed that low-carbon HSLA steels such as Cor-Ten™, even at high temperature, form under oxidising conditions an iron oxide-based surface layer which is dense, electrically conductive, electrochemically active for oxygen evolution and, as opposed to oxide layers formed on standard steels or other iron alloys, is highly adherent and less exposed to delamination and limits diffusion of ionic, mono-atomic and molecular oxygen.

HSLA steels are known for their strength and resistance to atmospheric corrosion especially at lower temperatures (below 0° C.) in different areas of technology such as civil engineering (bridges, dock walls, sea walls, piping), architecture (buildings, frames) and mechanical engineering (welded/bolted/riveted structures, car and railway industry, high pressure vessels). However, these HSLA steels have never been proposed for applications at high temperature, especially under oxidising or corrosive conditions, in particular in cells for the electrowinning of aluminium.

It has been found that the iron oxide-based surface layer formed on the surface of a HSLA steel under oxidising conditions limits also at elevated temperatures the diffusion of oxygen oxidising the surface of the HSLA steel. Thus, diffusion of oxygen through the surface layer decreases with an increasing thickness thereof.

If the HSLA steel is exposed to an environment promoting dissolution or delamination of the surface layer, in particular in an aluminium electrowinning cell, the rate of formation of the iron oxide-based surface layer (by oxidation of the surface of the HSLA steel) reaches the rate of dissolution or delamination of the surface layer after a transitional period during which the surface layer grows or decreases to reach an equilibrium thickness in the specific environment.

High-strength low-alloy (HSLA) steels are a group of low-carbon steels (typically up to 0.5 weight % carbon of the total) that contain small amounts of alloying elements. These steels have better mechanical properties and sometimes better corrosion resistance than carbon steels.

The surface of a high-strength low-alloy steel electrochemically active layer may be oxidised in an electrolytic cell or in an oxidising atmosphere, in particular a relatively pure oxygen atmosphere. For instance the surface of the high-strength low-alloy steel layer may be oxidised in a first electrolytic cell and then transferred to an aluminium production cell. In an electrolytic cell, oxidation would typically last 5 to 15 hours at 800 to 1000° C. Alternatively, the oxidation treatment may take place in air or in oxygen for 5 to 25 hours at 750 to 1150° C.

In order to prevent thermal shocks causing mechanical stresses, a high-strength low-alloy steel layer may be tempered or annealed after pre-oxidation. Alternatively, the high-strength low-alloy steel layer may be maintained at elevated temperature after pre-oxidation until immersion into the molten electrolyte of an aluminium production cell.

The high-strength low-alloy steel layer may comprise 94 to 98 weight % iron and carbon, the remaining constituents being one or more further metals selected from chromium, copper, nickel, silicon, titanium, tantalum, tungsten, vanadium, zirconium, aluminium, molybdenum, manganese and niobium, and optionally a small amount of at least one additive selected from boron, sulfur, phosphorus and nitrogen.

Advantageous Operating Conditions

It has been observed that iron oxides and in particular hematite ($Fe_2O_3$) have a higher solubility than nickel in molten electrolyte. However, in industrial production the contamination tolerance of the product aluminium by iron oxides is also much higher (up to 2000 ppm) than for other metal impurities.

Solubility is an intrinsic property of anode materials and cannot be changed otherwise than by modifying the electrolyte composition and/or the operating temperature of a cell.

Laboratory scale cell tests utilising a $NiFe_2O_4$/Cu cermet anode and operating under steady conditions were carried out to establish the concentration of iron in molten electrolyte and in the product aluminium under different operating conditions.

In the case of iron oxide it has been found that lowering the temperature of the electrolyte decreases considerably the solubility of iron species. This effect can surprisingly be exploited to produce a major impact on bipolar cell operation by limiting the contamination of the product aluminium by iron.

The solubility of iron species in the electrolyte can even be further reduced by keeping therein a sufficient concentration of dissolved alumina, i.e. by maintaining the electrolyte as close as possible to saturation with alumina. Maintaining a high concentration of dissolved alumina in the molten electrolyte decreases the solubility limit of iron species and consequently the contamination of the product aluminium by cathodically reduced iron.

Thus, it has been found that when the operating temperature of aluminium electrowinning cells is reduced below the temperature of conventional cells an anode coated with an outer layer of iron oxide can be made dimensionally stable by maintaining a concentration of iron species and dissolved alumina, in the molten electrolyte sufficient to suppress the dissolution of the anode coating but low enough not to exceed the commercially acceptable level of iron in the product aluminium, as disclosed in co-pending application PCT/IB99/01360 (Duruz/de Nora/Crottaz)

The solubility of iron species in the electrolyte may be also influenced by the presence in the electrolyte of other metal species, such as calcium, lithium, magnesium, nickel, sodium, potassium and/or barium species.

Based on the above observations, according to a further aspect of the invention, during operation the anode layer of the bipolar electrode may be kept dimensionally stable by maintaining in the electrolyte a sufficient concentration of iron species and dissolved alumina, the cell operating temperature being sufficiently low so that the required concentration of iron species in the electrolyte is limited by the reduced solubility of iron species in the electrolyte at the operating temperature, which consequently limits the contamination of the product aluminium by iron to an acceptable level.

The amount of dissolved iron preventing dissolution of the iron oxide-based anode layer may be such that the product aluminium is contaminated by no more than 2000 ppm iron, preferably by no more than 1000 ppm iron, and even more preferably by no more than 500 ppm iron.

The operating temperature of the electrolyte may be in the range from 750 to 910° C., preferably from 820 to 870° C. The electrolyte may contain NaF and $AlF_3$ in a weight ratio $NaF/AlF_3$ from about 0.74 to 0.82, generally from 0.7 to 0.85. The concentration of alumina dissolved in the electrolyte is below 8 weight %, preferably between 2 weight % and 6 weight %.

To maintain an amount of iron species in the electrolyte preventing the dissolution of the iron oxide-based anode layer, the cell can comprise means for intermittently or continuously feeding iron into the electrolyte.

The iron may be fed in the form of iron metal and/or an iron compound, such as iron oxide, iron fluoride, iron oxyfluoride and/or an iron-aluminium alloy.

The iron may be intermittently fed into the electrolyte together with alumina. Alternatively, a sacrificial electrode may continuously feed the iron into the electrolyte.

The dissolution of such a sacrificial electrode may be controlled and/or promoted by applying a voltage thereto which is lower than the voltage of oxidation of oxygen ions. The voltage applied to the sacrificial electrode may be adjusted so that the resulting current passing through the sacrificial electrode corresponds to a current necessary for the dissolution of the required amount of iron species into the electrolyte replacing the iron which is cathodically reduced and not otherwise compensated.

The teachings and principles disclosed hereabove relating operation of cells fitted with bipolar electrodes having a hematite anode layer are also applicable to any bipolar electrode whose electrochemically active anode layer comprises an oxidised transition metal, such as an oxidised nickel-cobalt alloy, as described above.

In particular, nickel-cobalt active anode surfaces may also be kept dimensionally stable by maintaining a sufficient amount of dissolved alumina and nickel and/or cobalt species in the electrolyte.

Cell Configurations

In generally, a cell according to the invention may also comprise means to improve the circulation of the electrolyte between the anodes and facing cathodes and/or means to facilitate dissolution of alumina in the electrolyte. Such circulation and/or dissolution may be achieved by moving the electrodes or by an adequate geometry of the cell.

When needed, the bipolar cell may comprise one or more inert, electrically non-conductive current confinement members arranged to inhibit or reduce current bypass around the edges of the bipolar electrodes. The current confinement member may be in the form of a rim projecting from the periphery of at least one bipolar electrode.

The surface of the current confinement member is resistant to the electrolyte and to oxygen where exposed to anodically released gas or to molten aluminium where exposed to the product aluminium and may consist of a non-conductive ceramic and/or a non-conductive oxide, such as silicon nitride, aluminium nitride, boron nitride, magnesium ferrite, magnesium aluminate, magnesium chromite, zinc oxide, nickel oxide and alumina.

The shape of the anode layer and cathode body of each bipolar may be substantially circular or rectangular, in particular square.

The bipolar electrodes may be inclined to the vertical, substantially vertical or substantially horizontal in the bipolar cell.

Cell Operating Temperature

Cells according to the invention may be operated with an electrolyte at conventional temperature, i.e. around 950 to 970° C., or preferably, as stated above, at reduced temperature in order to maintain certain types of anode layers, e.g. iron oxide-based anode layers, dimensionally stable.

Furthermore, when the carbon of the cathode body is directly exposed to the molten cell contents, to inhibit sodium penetration the electrolyte should be operated at reduced temperature, typically below 900° C., preferably from 700 to 870° C., or even lower, but above the melting point of aluminium.

Further Aspects of the Invention

The invention also relates to a bipolar electrode of a bipolar cell for the electrowinning of aluminium by the electrolysis of alumina dissolved in a molten fluoride-containing electrolyte, comprising an anode layer having an oxide-based outer surface, such as a transition metal oxide-based surface, in particular an iron oxide-based surface, connected to a carbon cathode body as described above.

Another aspect of the invention is a method of manufacturing a bipolar electrode as described above comprising a carbon cathode body connected to an anode layer having an oxide-based outer surface through an oxygen impermeable barrier layer. The method comprises either:

a) forming the oxygen barrier layer onto the cathode body directly or onto an intermediate bonding layer formed on the cathode body, and forming the anode layer onto the oxygen barrier layer directly or onto an intermediate protective layer formed on the oxygen barrier layer; or b) forming the oxygen barrier layer onto the anode body directly or onto an intermediate protective layer formed on the anode layer, and bonding the cathode body directly or through an intermediate bonding layer onto the oxygen barrier layer.

This method may also be carried out for reconditioning a bipolar electrode as described above whose anode layer is damaged, the method comprising clearing at least the damaged parts of the anode layer and then reconstituting at least the anode layer.

A further aspect of the invention is a method of producing aluminium in a bipolar cell as described above. The method comprises passing an electric current from the active surface of the terminal cathode to the active surface of the terminal anode as ionic current in the electrolyte and as electronic current through the or each bipolar electrode, thereby electrolysing the alumina dissolved in the electrolyte to produce aluminium on the active surfaces of the terminal cathode and of the or each cathode body, and to produce oxygen on the active surface of the terminal anode and of the or each anode layer.

DETAILED DESCRIPTION

The invention was tested in a laboratory scale bipolar cell as described in the following Examples

EXAMPLE 1

A bipolar electrode was made by coating one side of a graphite cathode body (3×7×1 cm) with a chromium oxide ($Cr_2O_3$) oxygen barrier layer having a thickness of about 50 micron and forming thereon an anode layer consisting of iron oxide.

The oxygen barrier layer was applied onto the cathode body by brushing a precursor slurry and consolidating by heat treatment under an argon atmosphere. The precursor slurry contained a suspended particulate chromium oxide in an inorganic $Cr^{3}$+ polymer solution consisting of concentrated chromium hydroxide containing 400 g/l of $Cr_2O_3$ equivalent.

The anode layer was applied onto the oxygen barrier layer by plasma spraying iron oxide powder to form an iron oxide layer having a thickness of about 1 mm.

The bipolar electrode so obtained was then placed between a terminal anode and a terminal cathode in a fluoride-based electrolyte at 850° C. containing NaF and $AlF_3$ in a molar ratio $NaF/AlF_3$ of 1.9 and approximately 6 weight % alumina, and tested at a current density of about 0.8 $A/cm^2$.

To inhibit dissolution of the iron-oxide anode layer, alumina and iron oxide were intermittently added to the electrolyte to replace the alumina and the iron species which were reduced at the cathode. This maintains in the electrolyte a concentration of iron species of approximately 180 ppm, which is sufficient to saturate or nearly saturate the electrolyte with iron species.

After 50 hours electrolysis, the bipolar electrode was extracted from the cell and showed no sign of significant internal or external corrosion after microscopic examination of a cross-section of the electrode specimen.

The composition of the produced aluminium was also analysed and showed the presence of 800 ppm of iron which is below the tolerated contamination of iron in commercially produced aluminium.

A variation of this bipolar electrode can be obtained by replacing the chromium oxide oxygen barrier layer with a layer of platinum having a thickness of about 15 micron applied directly onto the cathode body by electrochemical deposition. The bipolar electrode was tested under the same conditions and showed similar results.

EXAMPLE 2

A bipolar electrode was made by coating one side of a graphite cathode body with an Inconel® alloy layer about 500 micron thick consisting of 74 weight % nickel, 17 weight % chromium and 9 weight % iron, by arc spraying. A chromium oxide-based oxygen barrier layer was slurry applied onto the alloy layer and consolidated by heat treatment under an argon atmosphere as described in Example 1. A nickel layer about 200 micron thick and then a copper layer about 100 micron thick were successively applied onto the oxygen barrier layer by arc spraying. In a modification of the Example, the arc-sprayed layers may be electrodeposited.

The coated cathode body was heat treated at 1000° C. in argon for 5 hours. This heat treatment provides for the interdiffusion of nickel and copper to form an intermediate layer.

A nickel-ferrite powder was made by drying and calcining at 900° C. the gel product obtained from an inorganic polymer precursor solution consisting of a mixture of molten $Fe(NO_3)_3.9\ H_2O$ with a stoichiometric amount of $Ni(CO_3)_2.6H_2O$. A thick paste was made by mixing 1 g of this nickel-ferrite powder with 0.85 g of a nickel aluminate polymer solution containing the equivalent of 0.15 g of nickel oxide. This thick paste was then diluted with 1 ml of water and ground in a pestle and mortar to obtain a suitable viscosity to form a nickel-based paint.

An electrochemically active oxide layer was obtained on the intermediate layer by applying thereon the nickel-based paint with a brush. The painted structure was allowed to dry for 30 minutes before heat treating it at 500° C. for 1 hour to decompose volatile components and to consolidate the oxide coating.

The heat treated coating layer was about 15 micron thick. Further coating layers were applied following the same procedure in order to obtain a 200 micron thick electrochemically active coating covering the intermediate layer.

The bipolar electrode was then tested in a cryolite melt containing approximately 6 weight % alumina at 970° C. by passing a current at a current density of about 0.8 $A/cm^2$. After 100 hours the electrode was extracted from the cryolite and showed no significant internal corrosion after microscopic examination of a cross-section.

The Example was repeated, using instead an electrochemically active layer obtained from a feed prepared by slurrying nickel ferrite powder in an inorganic polymer solution having the required composition for the formation of $NiFe_2O_4$. The powder to polymer ratio was 1 to 0.25. Several layers of the coating feed were brushed onto the nickel-copper layer and heat treated to form the electrochemically active layer on the intermediate layer.

Alternatively, the Example can be repeated using instead an electrochemically active layer obtained from an amount of 1 g of commercially available nickel ferrite powder slurried with 1 g of an inorganic polymer consisting of a precursor of 0.25 g equivalent nickel-ferrite per 1 ml. An amount corresponding to 5 weight % of $IrO_2$ acting as an electrocatalyst for the rapid conversion of oxygen ions into monoatomic oxygen and subsequently gaseous oxygen can be added to the slurry as $IrCl_4$, as described in WO99/36592 (de Nora). The slurry can be brush-coated onto the interdiffused and at least partly oxidised nickel copper alloy layer by applying 3 successive 50 micron thick layers of the slurry, each slurry-applied layer should be allowed to dry by heat-treating the anode at 500° C. for 15 minutes between each layer application.

What is claimed is:

1. A bipolar cell for the electrowinning of aluminium by the electrolysis of alumina dissolved in a molten fluoride-containing electrolyte, having a terminal cathode, a terminal anode and thereinbetween at least one bipolar electrode comprising a carbon cathode body having on one side an active surface on which aluminium is produced and being connected on the other side through an oxygen impermeable barrier layer to an anode layer having a metal oxide-based outer surface which is electrochemically active for the oxidation reaction of oxygen ions into nascent monoatomic oxygen, as well as for subsequent reaction for the formation of gaseous biatomic molecular oxygen.

2. The bipolar cell of claim 1, wherein the oxygen barrier layer is made of at least one metal selected from chromium, niobium and nickel, or an oxide thereof.

3. The bipolar cell of claim 1, wherein the or each bipolar electrode comprises an inert electrically conductive intermediate protective or bonding layer located between the oxygen barrier layer and the anode layer or the cathode body, the intermediate layer comprising copper, or a copper nickel alloy, or oxide(s) thereof.

4. The bipolar cell of claim 1, wherein cathode body is made of carbon.

5. The cell of claim 4, wherein the carbon is selected from the group consisting of petroleum coke, metallurgical coke, anthracite, graphite, amorphous carbon, fullerene and low density carbon.

6. The bipolar cell of claim 1, wherein at least the side of the cathode body which is connected to the anode layer is impregnated and/or coated with a phosphate of aluminium and/or a boron compound.

7. The bipolar cell of claim 1, wherein the carbon of the cathode body is exposed to molten cell contents.

8. The bipolar cell of claim 1, wherein the cathode body comprises a drained alurninium-wettable outer coating, on which aluminium is produced.

9. The cell of claim 8, wherein the coating preferably comprises refractory hard metal boride.

10. The bipolar cell of claim 1, wherein the anode layer comprises a metal, an alloy, an intermetallic compound or a cermet.

11. The bipolar cell of claim 10, wherein the anode layer comprises at least one of nickel, copper, cobalt, chromium, molybdenum, tantalum, tungsten, iron, and their alloys or intermetallic compounds, and combinations thereof.

12. The bipolar cell of claim 11, wherein the anode layer has a transition metal oxide-based outer surface.

13. The bipolar cell of claim 12, wherein the anode layer has an iron oxide-based outer surface.

14. The bipolar cell of claim 13, wherein the anode layer comprises an anode substrate and an iron oxide-based outside layer which is an applied layer.

15. The bipolar of claim 14, wherein the anode layer is an oxidised low-carbon high-strength low-alloy (HSLA) layer which comprises 94 to 98 weight % iron and carbon, the remaining constituents being one or more further metals selected from chromium, copper, nickel, silicon, titanium, tantalum, tungsten, vanadium, zirconium, aluminium, molybdenum, manganese and niobium, and optionally a small amount of at least one additive selected from boron, sulfur, phosphorus and nitrogen.

16. The bipolar cell of claim 14, wherein the anode substrate alloy comprises 30 to 70 weight % iron and 30 to 70 weight % nickel.

17. The cell of claim 13, wherein the outer surface is hematite based.

18. The cell of claim 13, wherein the outside layer is obtained by oxidising the surface of the anode substrate which contains iron.

19. The bipolar cell of claim 12, wherein during operation the anode layer remains dimensionally stable by maintaining in the electrolyte a sufficient concentration of transition metal species corresponding to one or more metals present as oxides in the oxide-based outer anode surface, the cell operating temperature being sufficiently low so that the required concentration of said transition metal species in the electrolyte is limited by the reduced solubility of said transition metal species in the electrolyte at the operating temperature, which consequently limits the contamination of the product aluminium by said transition metal species to an acceptable level.

20. The bipolar cell of claim 19, wherein the anode layer has an iron oxide-based surface which remains dimensionally stable by maintaining in the electrolyte a sufficient concentration of iron species.

21. The bipolar cell of claim 10, wherein during normal operation in the cell the anode layer is slowly consumable by oxidation of its surface and dissolution into the electrolyte of the formed surface oxide.

22. The bipolar cell of claim 10, wherein the electrochemically active surface of the anode layer comprises spinels and/or perovskites.

23. The bipolar cell of claim 1, comprising at least one inert, electrically non-conductive current confinement member arranged to inhibit or reduce current bypass around the edges of the anode layer and the cathode body of the bipolar electrodes.

24. The bipolar cell of claim 1, wherein the bipolar electrodes are vertical or inclined to the vertical.

25. The bipolar cell of claim 1, wherein the bipolar electrodes are substantially horizontal.

26. A bipolar electrode of a bipolar cell for the electrowinning of aluminium by the electrolysis of alumina dissolved in a molten fluoride-containing electrolyte, comprising an anode layer having a metal oxide-based outer surface connected to a carbon cathode body as defined in claim 1.

27. A method of manufacturing a bipolar electrode according to claim 26 comprising a carbon cathode body connected to an anode layer having a metal oxide-based outer surface through an oxygen impermeable barrier layer, the method comprising either:

a) forming the oxygen barrier layer onto the cathode body directly or onto an intermediate bonding layer formed on the cathode body, and forming the anode layer onto the oxygen barrier layer directly or onto an intermediate protective layer formed on the oxygen barrier layer; or b) forming the oxygen barrier layer onto the anode body directly or onto an intermediate protective layer formed on the anode layer, and bonding the cathode body directly or through an intermediate bonding layer onto the oxygen barrier layer.

28. The method of claim 27, for reconditioning a bipolar electrode of a bipolar cell for the electrowinning of aluminium by the electrolysis of alumina dissolved in a molten fluoride-containing electrolyte, comprising an anode layer having a metal oxide-based outer surface connected to a carbon cathode body as defined in claim 1, said anode layer being damaged, the method comprising clearing at least the damaged parts of the anode layer and then reconstituting at least the anode layer.

29. A method of producing aluminium in a bipolar cell according to claim 1, comprising passing an electric current from the active surface of the terminal cathode to the active surface of the terminal anode as ionic current in the electrolyte and as electronic current through the or each bipolar electrode, thereby electrolysing the alumina dissolved in the electrolyte to produce aluminium on the active surfaces of the terminal cathode and of the or each cathode body, and to produce oxygen on the active surfaces of the terminal anode and of the or each anode layer.

30. The method of claim 29, wherein the anode layer of the bipolar electrode has a transition metal oxide-based outer surface, the method comprising keeping the anode layer of the or each bipolar electrode dimensionally stable during electrolysis by maintaining a sufficient concentration of dissolved alumina and transition metal species in the electrolyte which are present as one or more corresponding transition metal oxides in the electrochemically-active layer, and operating the cell at a sufficiently low temperature so that the required concentration of said transition metal species in the electrolyte is limited by the reduced solubility thereof in the electrolyte at the operating temperature, which consequently limits the contamination of the product aluminium by said transition metal species to an acceptable level.

31. The method of claim 30, wherein the anode layer has an iron oxide-based outer surface, the method comprising maintaining a sufficient concentration of iron species in the electrolyte.

32. The method of claim 31, wherein the bipolar cell is operated at an electrolyte temperature in the range from 820 to 870° C.

33. The method of claim 31, wherein the amount of dissolved iron preventing dissolution of the iron oxide-based anode layer is such that the product aluminium is contaminated by no more than 2000 ppm iron.

34. The method of claim 33, wherein the contamination is by no more than 1000 ppm iron.

35. The method of claim 34, wherein the contamination is by no more than 500 ppm iron.

36. The method of claim 31, wherein iron is intermittently or continuously fed into the electrolyte to maintain the amount of iron species in the electrolyte which prevents at the operating temperature the dissolution of the anode iron oxide-based layer.

37. The method of claim 36, wherein the iron is fed into the electrolyte in the form of iron oxide, iron fluoride, iron oxyfluoride and/or an iron-aluminium alloy.

38. The method of claim 36, wherein the iron is intermittently or continuously fed into the electrolyte together with alumina.

39. The method of claim 38, wherein a sacrificial electrode continuously feeds iron into the electrolyte.

* * * * *